US005983596A

United States Patent [19]

Corniani et al.

[11] Patent Number: 5,983,596

[45] Date of Patent: Nov. 16, 1999

[54] DEVICE FOR SCREWING A CAP ON THE NECK OF A CONTAINER

[75] Inventors: Carlo Corniani; Renzo Vesentini, both of Marmirolo, Italy

[73] Assignee: Azionaria Costruzioni Macchine Automatiche A.C.M.A. S.p.A., Bologna, Italy

[21] Appl. No.: 09/073,264

[22] Filed: May 6, 1998

[30] Foreign Application Priority Data

Jun. 5, 1997 [IT] Italy ..... 97000270

[51] Int. Cl.[6] ..... B65B 3/20; B65B 7/28

[52] U.S. Cl. ..... 53/317; 53/331.5

[58] Field of Search ..... 53/317, 331.5, 53/306, 307, 334

[56] References Cited

U.S. PATENT DOCUMENTS 3,303,633 2/1967 Wilhere .
4,232,499 11/1980 Holstein .
4,616,466 10/1986 Tanaka ..... 53/331.5
5,490,369 2/1996 Ellis ..... 53/317

FOREIGN PATENT DOCUMENTS 536 460 4/1993 European Pat. Off. .
677 482 10/1995 European Pat. Off. .

*Primary Examiner*—John Sipos
*Attorney, Agent, or Firm*—Pillsbury Madison & Sutro LLP

[57] ABSTRACT

The invention relates to a device for screwing a cap on the neck of a container, said device comprising gripper means designed to tighten round the screw cap and to rotate it so as to screw it on to the neck of the container, actuating means designed to act on the gripper means in such a way as to rotate them about a longitudinal axis of the device, transmitting to them a drive torque that rotates the caps, and coupling elements fitted between the actuating means and the gripper means and designed to enable the transmission of torque and, when the torque exceeds a preset value, to interrupt it; means being envisaged for inhibiting transmission even when the torque falls below the preset value.

40 Claims, 3 Drawing Sheets

DEVICE FOR SCREWING A CAP ON THE NECK OF A CONTAINER

BACKGROUND OF THE INVENTION

The present invention relates to a device for screwing a cap on to the neck of a container.

Known devices for screwing caps on to the necks of containers are equipped with a plurality of gripper means designed to hold the cap and to screw it on to the neck of the container. In these devices, the gripper means are rotated by appropriate drive means through an adjustable clutch.

Once the cap has been screwed on completely, the clutch through which the rotary motion is transmitted to the grippers, starts slipping when the resistant torque on the gripper means exceeds the value at which the clutch has been set, thus interrupting the connection between the actuating means and the gripper means. The gripper means therefore stop, while the drive means continue to rotate.

At this point, the gripper means are gradually opened to disengage them from the cap and to allow the next container to be fed into the device.

When the gripper means start opening, as soon as the pressure they exert on the side of the cap begins to slacken off, the resistant torque decreases and the clutch restores the connection between the rotary actuating means and the gripper means. As a result, the grippers slide on the side of the cap for a short length before being completely disengaged from the cap. This damages the side of the cap and may give rise to unattractive scoring.

Attempts were made to overcome this problem by coating the gripping surfaces of the grippers with resilient material, such as rubber, for example, in order to protect the side of the cap when the gripper means slide over it but this kind of material wears out quickly and loses its effectiveness in a very short time.

The aim of the present invention is to overcome the disadvantages mentioned above.

SUMMARY OF THE INVENTION

This aim is achieved by the invention by providing a device for screwing a cap on the neck of a container without damaging the cap.

The device for screwing a cap on the neck of a container as provided by the present invention comprises gripper means designed to engage the cap and rotate it in order to screw it on to the neck, rotary actuating means for rotating the gripper means about a longitudinal axis of the device, transmitting to them a drive torque that rotates the caps, and coupling elements fitted between the actuating means and the gripper means, said device being characterized in that it has means for inhibiting engagement designed to inhibit the transmission of said torque.

BRIEF DESCRIPTION OF THE DRAWINGS

The invention will now be described with reference to the accompanying drawings which illustrate two preferred embodiments of the invention and in which.

DESCRIPTION OF THE PREFERRED EMBODIMENTS

Figure 1:
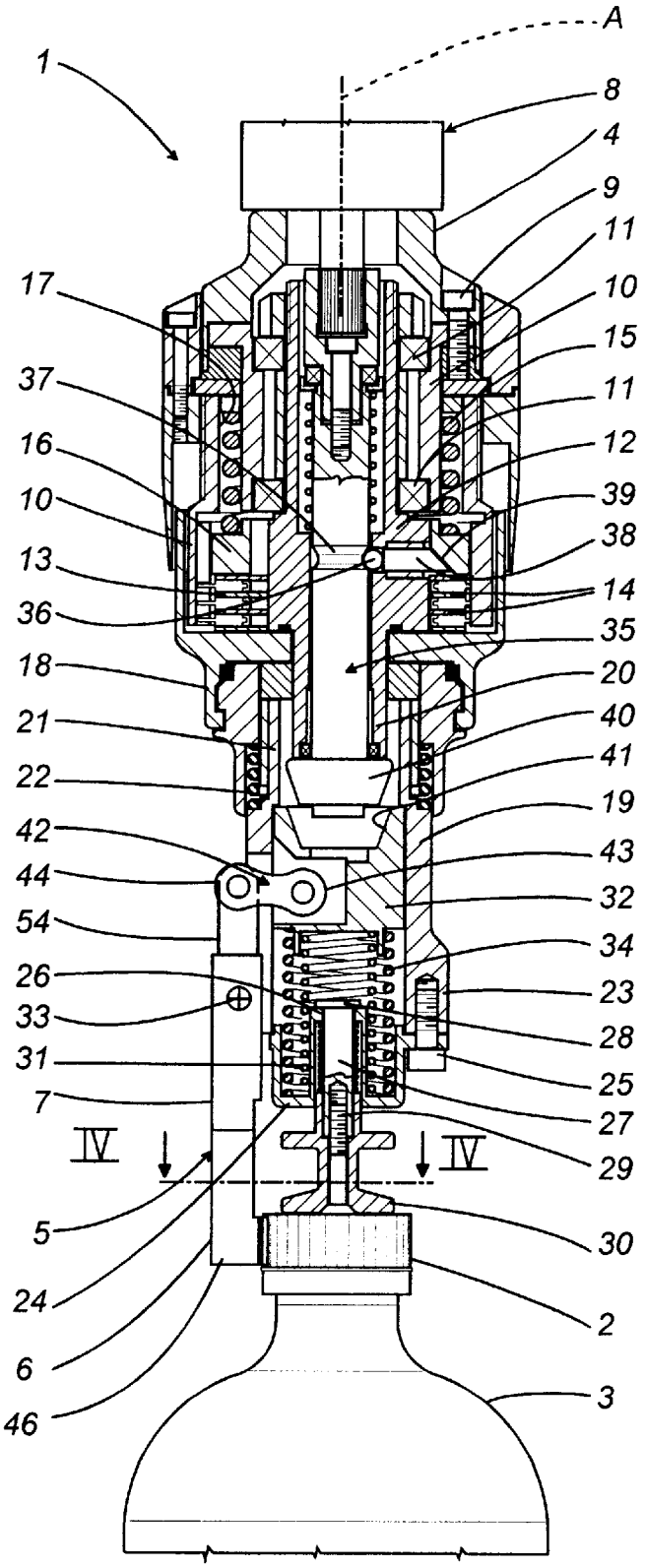
FIGS. 1, 2 and 3 are schematic, lengthways cross sections of a cap screwing device in three different working states.
Figure 4:
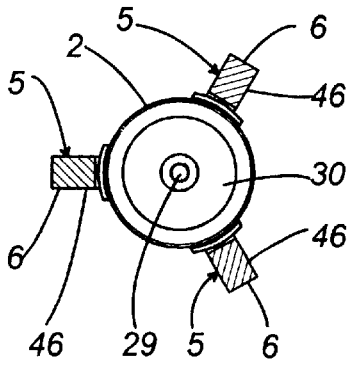
FIG. 4 is a schematic cross section of FIG. 1 along line IV—IV.

With reference to FIG. 1, the numeral 1 indicates as a whole a device for screwing caps 2 on containers 3. The device 1 comprises gripper means 5 consisting of a plurality of jaws 6 mounted by corresponding arms 7, preferably three jaws placed at angular intervals of 120° from each other on a circle centred about a longitudinal axis A of the device 1. The jaws 6 are designed to close round the side of the cap 2 and to rotate it in such a way as to screw it on to the neck of a container 3.

The arms 7 which mount the jaws 6 are rotated about the axis A by actuating means consisting, for example, of a bell 4 which is rotated about the axis A by drive means 8 and inside which there is a sleeve 10 attached by screws 9, a first hollow shaft 12 being in turn coaxially mounted inside the sleeve by means of bearings 11 in such a way that it can turn.

Between the sleeve 10 and the first hollow shaft 12 there are clutch means 13, 14, for example a disc clutch, comprising a plurality of first clutch rings 13 attached to a lower section of the inner surface of the sleeve 10, and a plurality of second clutch rings 14 attached to the outer surface of the first hollow shaft 12.

Inside the sleeve 10 there is a cavity 17 which houses a first elastic element 15, for example a helical spring, which exerts a force of adjustable intensity on a ring 16 fitted concentrically round the outside of the first hollow shaft 12 and able to slide axially along the latter. The ring 16 transmits the force to the first clutch rings 13, pushing them against the second clutch rings 14.

The maximum value of the drive torque that can be transmitted by the bell 4 to the hollow shaft 12 through the clutch means 13, 14 is directly proportional to the intensity of the force which the spring 15 exerts on the first rings 13. If the drive torque transmitted by the drive means 8 to the bell 4 exceeds the maximum value, the first clutch rings 13 begin to slip relative to the second clutch rings 14, thus interrupting the transmission of the rotary motion between the sleeve 10 and the first hollow shaft 12.

Attached to the lower section of the first hollow shaft 12 by means of screws, which are not illustrated, there is a hollow fitting 18 into which a narrow end 20 of the first hollow shaft 12 is inserted. The fitting 18 also houses a first end 21 of a second hollow shaft 19 fitted coaxially round the outside of the end 20. The second hollow shaft 19 is coupled to the fitting 18 in such a way that it can slide axially, but cannot rotate, relative to it. The axial sliding motion of the second hollow shaft 19 relative to the fitting 18 is elastically opposed by a second elastic element 22.

A second end 23 of the second hollow shaft 19 is closed by a hollow closing element 24, attached to the second end 23 by means of screws 25.

The hollow closing element 24 has a hollow protrusion 26 facing the inside of the second hollow shaft 19, into which a pin 27 is inserted, the end of the pin towards the inside of the hollow shaft 19 having a head 28 that stops the pin 27 from sliding in one direction inside the hollow protrusion 26.

The end of the pin 27 opposite the head 28 mounts a pressure element 30, attached by means of a screw 29 and exerting on the cap 2 of the container 3 a force which facilitates the placement of the cap 2 on the neck of the container 3 when the screwing action on the cap 2 starts.

The pressure element 30 is pushed elastically against the cap 2 by a third elastic element 31 placed inside the hollow protrusion 26.

The hollow shaft 19 houses a slider element 32 that runs in the direction of the axis A.

Between the slider element 32 and the closing element 24 there is a third elastic element 34 consisting, for example, of a pair of helical springs acting in parallel, designed to exert a preset, adjustable force on the slider 32 itself.

The outer surface of the slider element 32 has hinged to it a first end 43 of a plurality of rocker arms or rods 42, for example, a group of three arms mounted round the axis A at angular intervals of 120° from each other.

A second end 44 of the rocker arms 42 has hinged to it a first end 54 of a corresponding arm 7, at the opposite end of which there is attached a corresponding jaw 6 of the gripper means 5.

Each arm 7 is also hinged, at an intermediate point of it, to a pin 33 attached to a corresponding projection, not illustrated in the drawings, on the outer surface of the second hollow shaft 19. The axis of the pin 33 is arranged in such a manner that the arm 7 can rotate in a plane containing the axis A.

The device 1 also comprises means for inhibiting engagement designed to inhibit the transmission of the rotary motion between the sleeve 10 and the first hollow shaft 12 even when the torque transmitted by the drive means 8 is less than the preset maximum value.

Figure 2:
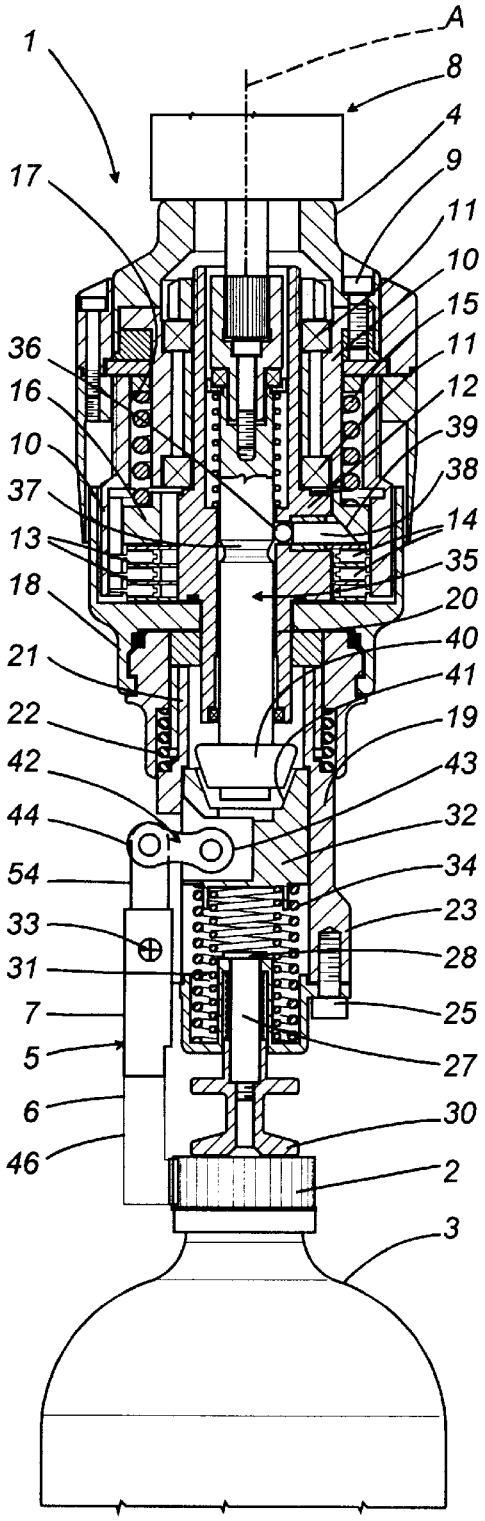
Figure 3:
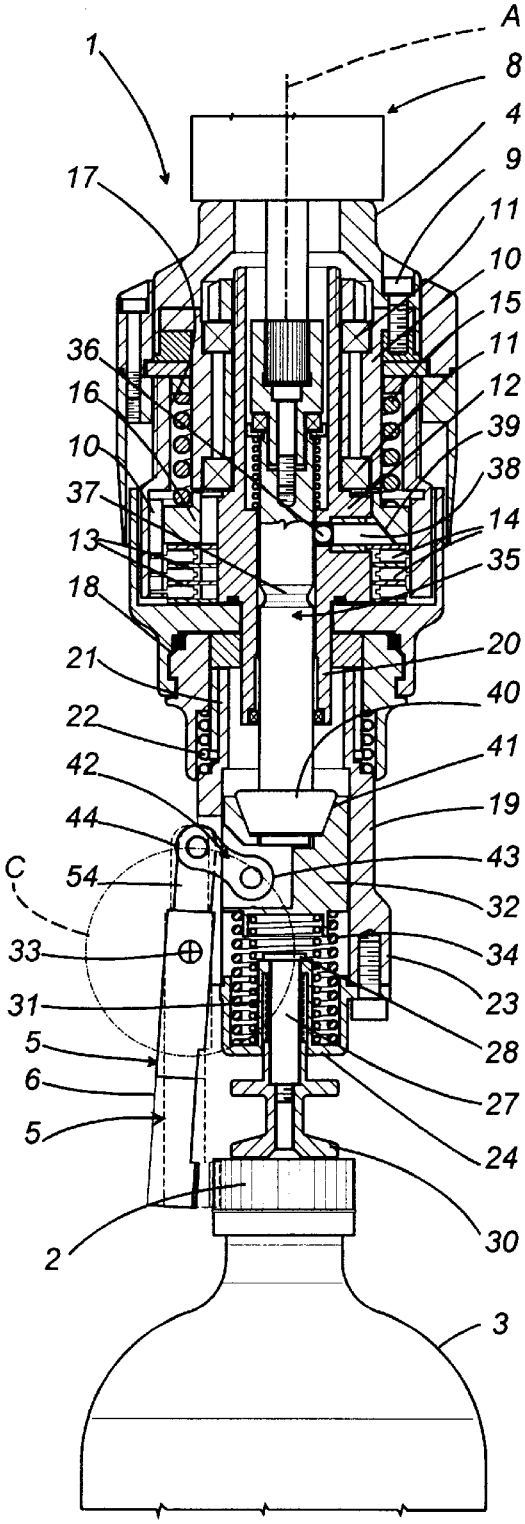

The means for inhibiting engagement comprise a drive element 35 in the form of a stem, fitted in such a way that it can slide inside the first hollow shaft 12 and has a race 37 all the way round it which engages a plurality of balls, preferably a group of three balls 36 placed at angular intervals of 120° from each other along the race 37. Each ball 36 rests against a thrust element 38 that slides radially in a corresponding radial hole through the first hollow shaft 12. The radially outermost end of each thrust element 38 has a wedge-shaped surface 39, preferably in the shape of a truncated cone, which mates with a corresponding section of surface on the radially inner face of the ring 16. When the stem element 35 is pushed downwards (see FIG. 2) the balls 36 protrude from the race 37 causing the thrust elements 38 to slide outwards radially. Thanks to the interaction of the truncated cone shaped surfaces 39 with the matching surfaces of the ring 16, the balls 36 in turn push the ring upwards so as to cancel the thrust force that it transmits to the first clutch rings 13. In this way, since there is no longer any friction between the first clutch rings 13 and the second clutch rings 14, no rotary motion is transmitted between the sleeve 10 and the first hollow shaft 12, even if the value of the drive torque transmitted by the drive means 8 is less than the preset maximum value.

At the lower end of the stem element 35, there is a head 40 designed to slot into a matching socket 41 made in the upper face of the slider element 32. The function of the head 40 is to open the jaws 6 when the cap 2 has been screwed on completely, once the means for inhibiting engagement have interrupted the transmission of the rotary motion to the hollow shaft 12. As the stem element 35 continues to move down after the means for inhibiting engagement have interrupted the transmission of the rotary motion, the head 40, which will hereinafter be referred to as "antirotation head", is pushed into the socket 41 and in turn pushes the slider element 32 down, against the opposing action of the springs 34. As a result, the first end 43 of each rocker arm 42 is also pushed down, thus forcing the second end 44 to rotate in a circle C centred about the axis of the pin 33 and therefore to move towards the axis A of the device, causing the corresponding arm 7 to rotate also and thus causing the corresponding jaw 6 to move away from the side of the cap 2, so as to enable another container 3 to be positioned under the device 1 so that a cap 2 can be screwed on to it.

The head 40 may be shaped like a wedge, a prism, a cone or a pyramid or it may have a grooved profile so as to form an antirotation fit with the socket 41 to prevent the jaws 6 from turning as they open.

Therefore, the antirotation fit between the head 40 of the stem element 35 and the socket 41 in the slider element 32 prevents the jaws 6 from accidentally damaging the side of the cap 2 when they open.

Once another container 3 has been positioned under the device 1, the stem element 35 is driven to rise to its initial position again, illustrated in FIG. 1. As the stem element 35 rises, the slider element 32 also rises inside the second hollow shaft 19, causing the arms 7 to rotate in the opposite direction to the previous so that the jaws 6 come into contact with the side of the cap 2 and are tightened round it by the action of the springs 34 on the slider element 32. Once the jaws 6 have closed, when the stem element 35 reaches the position shown in FIG. 1, the thrust force of the spring 15 on the ring 16 causes the thrust elements 38 to move radially inwards and the balls 36 to move back into the race 37. When this happens, the ring 16 rests against the first clutch rings 13 again, thus transmitting the force of the spring 15 to them, and re-establishing transmission of the rotary motion to the jaws 6 to enable the latter to screw on the cap. When the cap 2 has been screwed on completely, the resistant torque transmitted by the cap to the jaws 6 increases suddenly until it exceeds a preset maximum value of the drive torque. As soon as the resistant torque exceeds the preset maximum value of the torque that can be transmitted through the clutch means 13 and 14, the first clutch rings 13 start slipping relative to the second rings 14, thus disabling transmission of rotary motion to the jaws 6 and preventing the cap 2 from continuing to rotate to avoid damaging the thread in the cap and on the neck of the container.

As soon as transmission of the rotary motion to the jaws 6 is interrupted, a linear actuator or cam of known type (not illustrated) causes the stem element 35 to move down to disengage the clutch means 13 and 14 and to open the jaws 6 without allowing the jaws to rub against the side of the cap 2.

Figure 5:
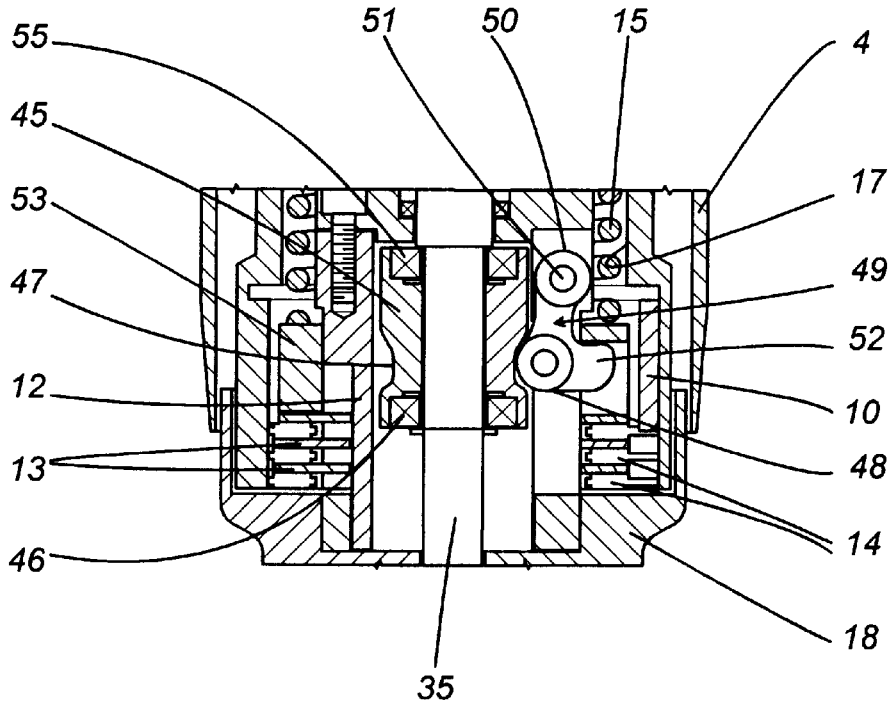
FIG. 5 is a schematic, lengthways cross section of another embodiment of the device illustrated in FIG. 1 in a first working state.
Figure 6:
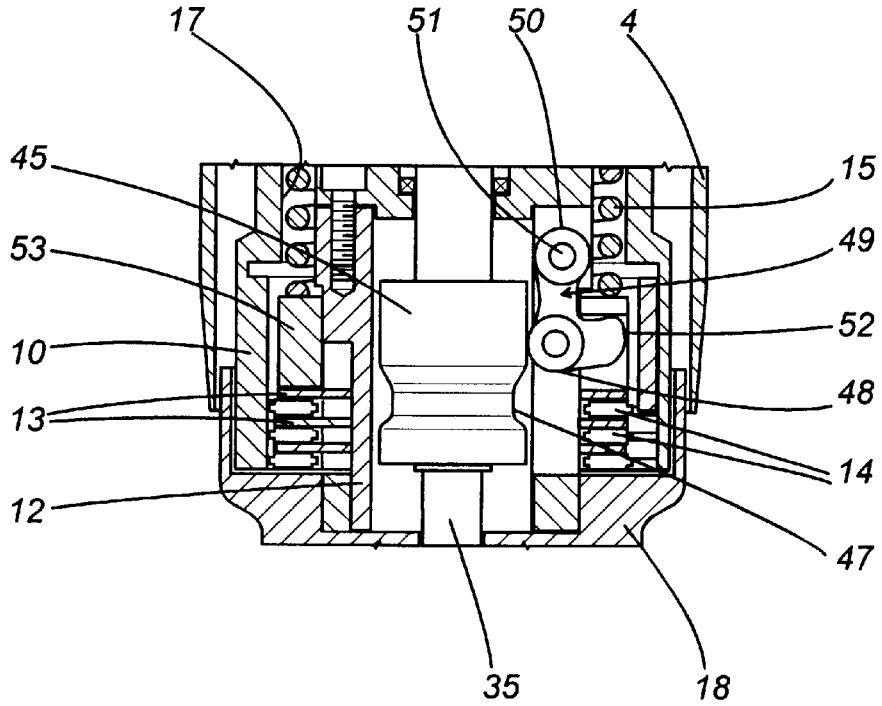
FIG. 6 is a schematic, lengthways cross section of the device illustrated in FIG. 5 in a second working state.

FIGS. 5 and 6 illustrate another embodiment of the means for inhibiting engagement where a sleeve 45 is mounted over a stem 35 on rolling contact bearings 55 in such a way that it can rotate. The sleeve 45 has a groove 47 round it, with an asymmetrical profile for example, into a which a protruding part 48 of an L-shaped lever 49 can be inserted, said lever having a first end 50 hinged to a pin 51 that protrudes from the hollow shaft 12 and a second end 52 designed to engage a socket in a ring 53, similar to the ring 16, which is mounted coaxially in such a way that it can slide over the hollow shaft 12 and can be pushed down by the spring 15.

The ring 53 transmits the force of the spring 15 to the first clutch discs 13 so as to transmit the rotary motion from the sleeve 10 to the first hollow shaft 12 through the second clutch discs 14.

When the stem element 35 is pushed down, after the cap 2 has been screwed on, the sleeve 45 follows the movement of the stem element 35, pushing the protruding part 48 of the lever 49 out of the groove 47 so that it acts on the lever 49 in the same way as a cam. In this way, the lever 49 rotates about the pin 51 and its second end 52 pushes the ring 53 upwards and cancels the force that it transmits to the first discs 13. Thus, since there is no longer any friction between the first clutch discs 13 and the second clutch discs 14, transmission of the rotary motion between the sleeve 10 and the first hollow shaft 12 is disabled, even if the torque transmitted by the drive means 8 is less than the maximum preset value.

What is claimed:

1. A device for screwing a cap on the neck of a container which comprises gripper means designed to rotate the cap so as to screw it on to the neck of the container and to tighten the cap on said container to a predetermined value, rotary actuating means designed to act on the gripper means in such a way as to rotate them about a longitudinal axis of the device, transmitting to them a drive torque that rotates the caps, and coupling elements fitted between the rotary actuating means and the gripper means, said device being characterized in that it also comprises means for inhibiting engagement designed to inhibit transmission of said torque to said gripper means when said torque exceeds said predetermined value and when said torque falls below said predetermined value.

2. The device according to claim 1 wherein the means for inhibiting engagement are designed to inhibit transmission in particular when the drive torque changes from a value that is above a specified amount by a preset value to a value below it by the same preset value.

3. The device according to claim 1 wherein the means for inhibiting engagement act on the coupling means in such a way as to prevent transmission of the drive torque through the latter.

4. The device according to claim 1 wherein the coupling means comprise clutch means.

5. The device according to claim 1 wherein the means for inhibiting engagement comprise a drive element that can move from a first position in which the means for inhibiting engagement are inoperative to at least one second position in which the means for inhibiting engagement are operative.

6. The device according to claim 5 wherein the drive element assumes a third position in which it acts on the gripper means while the means for inhibiting engagement continue to be operative.

7. The device according to claim 5 wherein the drive element, when it is in the operative position, acts on the gripper means.

8. The device according to claim 5 wherein the drive element moves in the direction of the longitudinal axis.

9. The device according to claim 1 wherein the rotary actuating means comprise a bell which is rotated about the axis by drive means, a sleeve attached to the inside of the bell and a first hollow shaft mounted coaxially inside the sleeve in such a way that it can turn.

10. The device according to claim 9 wherein the coupling means are located between the sleeve and the first hollow shaft.

11. The device according to claim 9 wherein the drive element is located inside the first hollow shaft.

12. The device according to claim 9 wherein the coupling elements comprise at least one first clutch ring fixed to a lower section of the inner surface of the sleeve and at least one second clutch ring fixed to the outer surface of the first hollow shaft.

13. The device according to claim 12 wherein the sleeve houses a first elastic element which acts on rings so as to maintain a reciprocal pressure between the first clutch ring and the second clutch ring.

14. The device according to claim 13 wherein the rings are mounted coaxially in relation to the hollow shaft in such a way that they can slide over it.

15. The device according to claim 13 wherein the means for inhibiting engagement act on the coupling means in such a way as to prevent transmission of the drive torque through the latter, and the means for inhibiting engagement comprise at least one push element designed to act on the rings in such a way as to cancel the reciprocal pressure under the action of an active part of the drive element.

16. The device according to claim 15 wherein the push element comprises a plurality of push elements located on a circle at regular angular intervals.

17. The device according to claim 15 wherein the push element can slide in a corresponding substantially radial through hole in the first hollow shaft.

18. The device according to claim 15 wherein between the push element and the drive element there are rolling means which roll on the active part.

19. The device according to claim 15 wherein the active part comprises a recess in the drive element.

20. The device according to claim 19 wherein the recess forms a groove in the drive element.

21. The device according to claim 3 or 4 wherein the drive element comprises a stem element.

22. The device according to claim 18 wherein the active part is made on the stem element.

23. The device according to claim 5 wherein the drive element also comprises a sleeve element round the stem element.

24. The device according to claim 15 wherein the active part is made on the sleeve element.

25. The device according to claim 15 or 16 wherein the radially outermost end of the thrust element has a wedge-shaped surface which mates with a corresponding section of surface on the radially inner face of the ring.

26. The device according to claim 15 wherein the push element is a lever element.

27. The device according to claim 26 wherein the lever element is L-shaped.

28. The device according to claim 26 wherein the lever element has a first end hinged to a pin that protrudes from the hollow shaft and a second end designed to engage a matching surface of the ring.

29. The device according to claim 26 wherein the lever element has a protrusion which can be received by the active part.

30. The device according to claim 9 wherein the first hollow shaft is rotationally coupled to a second hollow shaft through which the gripper means are rotated.

31. The device according to claim 30 wherein between the first hollow shaft and the second hollow shaft there is a second elastic element.

32. The device according to claim 30 wherein a slider element to which the gripper means are hinged, slides inside the second hollow shaft.

33. The device according to claim 32 wherein an end of the arms of the gripper means is hinged to the slider element through corresponding rods.

34. The device according to claim 32 wherein the second hollow shaft is hinged to the middle of each arm.

35. The device according to claim 32 wherein the stem element has an antirotation head designed to slot into a matching socket in the slider element.

36. The device according to claim 35 wherein the anti-rotation head has the shape of a wedge, a cone, a prism, a truncated pyramid or has a grooved profile.

37. The device according to claim 32 wherein the slider element slides inside the second hollow shaft against the action of a third elastic element.

38. The device according to claim 37 wherein the third elastic element enables the jaws to tighten round the cap.

39. The device according to claim 32 wherein the end of the hollow shaft facing the cap is closed by a hollow closing element elastically coupled to a pressure element designed to exert pressure on the cap.

40. The device according to claim 38 or 39 wherein the closing element houses one end of the third elastic element.

* * * * *